US005313688A

United States Patent [19]

Leifeld et al.

[11] Patent Number: 5,313,688

[45] Date of Patent: May 24, 1994

[54] FIBER WASTE SEPARATOR INCLUDING CARRIERS, MOVABLE COVERS, AND SUCTION HOOD

[75] Inventors: Ferdinand Leifeld, Kempen; Konrad Temburg, Monchen-Gladbach, both of Fed. Rep. of Germany

[73] Assignee: Trützschler GmbH & Co. KG, Mönchengladbach, Fed. Rep. of Germany

[21] Appl. No.: 760,988

[22] Filed: Sep. 17, 1991

[30] Foreign Application Priority Data

Sep. 17, 1990 [DE] Fed. Rep. of Germany ..... 4029415

[51] Int. Cl.[5] ..... D01G 9/06; D01G 9/20

[52] U.S. Cl. ..... 19/107; 19/203

[58] Field of Search ..... 19/98, 99, 104, 108, 19/109, 107, 113, 202, 296

[56] References Cited

U.S. PATENT DOCUMENTS

| | | | |
|---|---|---|---|
| 2,289,017 | 7/1942 | Jenkins et al. | 19/107 |
| 3,537,144 | 11/1970 | King, Jr. | 19/107 |
| 3,707,020 | 12/1972 | Stewart | 19/107 |
| 4,271,564 | 6/1981 | Estebanell | 19/107 X |
| 4,355,439 | 10/1982 | Estebanell | 19/107 X |
| 4,524,492 | 6/1985 | Elliott | 19/107 |
| 4,539,728 | 9/1985 | Portell | 19/107 X |
| 4,654,933 | 4/1987 | Horn et al. | 19/107 X |
| 4,815,170 | 3/1989 | Portell | 19/107 X |
| 4,958,404 | 9/1990 | Lasenga | 19/98 |
| 5,016,321 | 5/1991 | Hollingsworth et al. | 19/107 X |
| 5,031,279 | 7/1991 | Temburg | 19/107 |
| 5,146,652 | 9/1992 | Leifeld | 19/200 X |

FOREIGN PATENT DOCUMENTS

| | | | |
|---|---|---|---|
| 0637541 | 3/1962 | Canada | 19/107 |
| 0423856 | 4/1991 | European Pat. Off. . | |
| 2728015 | 9/1986 | Fed. Rep. of Germany . | |
| 3821771 | 1/1989 | Fed. Rep. of Germany . | |
| 3825419 | 2/1990 | Fed. Rep. of Germany . | |
| 3902202 | 8/1990 | Fed. Rep. of Germany . | |
| 0018051 | 6/1970 | Japan | 19/107 |
| 109444 | 2/1918 | United Kingdom . | |
| 1166069 | 10/1969 | United Kingdom . | |
| 2205590 | 12/1988 | United Kingdom . | |
| 2222607 | 3/1990 | United Kingdom | 19/107 |
| 2228495 | 8/1990 | United Kingdom | 19/108 |
| 2240995 | 8/1991 | United Kingdom | 19/108 |

*Primary Examiner*—Clifford D. Crowder
*Assistant Examiner*—Ismael Izaguirre
*Attorney, Agent, or Firm*—Spencer, Frank & Schneider

[57] ABSTRACT

A fiber processing machine includes two oppositely rotated, tangentially cooperating first and second clothed rolls, wherein the first roll is an upstream roll and the second roll is a downstream roll as viewed in a travelling direction of fiber material being entrained by the rolls on fiber-advancing portions thereof. The rolls have a generally horizontal axis of rotation and together define opposite first and second converging gaps. A first carrier is disposed in the first converging gap and partially extends over a circumferential portion of the first and second rolls. A mote knife is mounted on the first carrier and bounds a waste discharge opening situated circumferentially along one of the rolls. The first carrier has a carrier part partially covering the fiber-advancing portion of the first roll; and an additional curved carrier part extends along a circumference of the second roll. The additional curved carrier part defines an air intake gap with the second roll. There is also provided a second carrier disposed in the second converging gap; the second carrier has curved carrier parts extending over portions of circumferences of the first and second rolls.

11 Claims, 3 Drawing Sheets

FIBER WASTE SEPARATOR INCLUDING CARRIERS, MOVABLE COVERS, AND SUCTION HOOD

CROSS REFERENCE TO RELATED APPLICATION

This application claims the priority of German Application No. P 40 29 415.3 filed Sep. 17, 1990, which is incorporated herein by reference.

BACKGROUND OF THE INVENTION

1. Field of the Invention

This invention relates to an apparatus for separating waste from fiber material, such as cotton fiber, as it is being advanced by a clothed roller in a fiber processing machine, such as a cleaner or a card. The apparatus is of the type wherein a carrier is arranged in a generally triangular space (bight or converging gap) defined by two- closely cooperating, oppositely rotated rolls (provided with a sawtooth or pin clothing). The carrier has curved edge surfaces which cover one part of the circumference of both cooperating rolls.

2. Background Art

In a known apparatus, in the lower bight formed by a clockwise rotating first (upstream) and a counterclockwise rotating second (downstream) roll a carrier is positioned and an adjustable guide element is provided at the outlet side of a curved cover following the circumference of the second roll. In the zone of the cover situated at the first roll, the latter entrains no fiber material so that the cover functions there only as a shroud.

SUMMARY OF THE INVENTION

It is an object of the invention to provide an improved apparatus of the above-outlined type in which the treatment and separation of the fibers as well as the guidance of the air stream are improved.

This object and others to become apparent as the specification progresses, are accomplished by the invention, according to which, briefly stated, the fiber processing machine includes two oppositely rotated, tangentially cooperating first and second clothed rolls. The first roll is an upstream roll and the second roll is a downstream roll as viewed in a travelling direction of the fiber material being entrained by the rolls on fiber-advancing portions thereof. The rolls have a generally horizontal axis of rotation and together define opposite first and second bights. A carrier is disposed in the first bight and partially covers a circumferential portion of the first and second rolls. A mote knife is mounted on the carrier and bounds a waste discharge opening situated circumferentially along one of the rolls. Further, the carrier has a carrier part partially covering the fiber-advancing portion of the first roll.

By virtue of the invention it is feasible to utilize, in a combined manner, the carrier for the cleaning of the fiber material and for sealing the bight between two rolls, whereby the fiber separation from the upstream roll, the transfer of the fiber onto the downstream roll and the air guidance are improved.

DESCRIPTION OF THE PREFERRED EMBODIMENT

Figure 1:
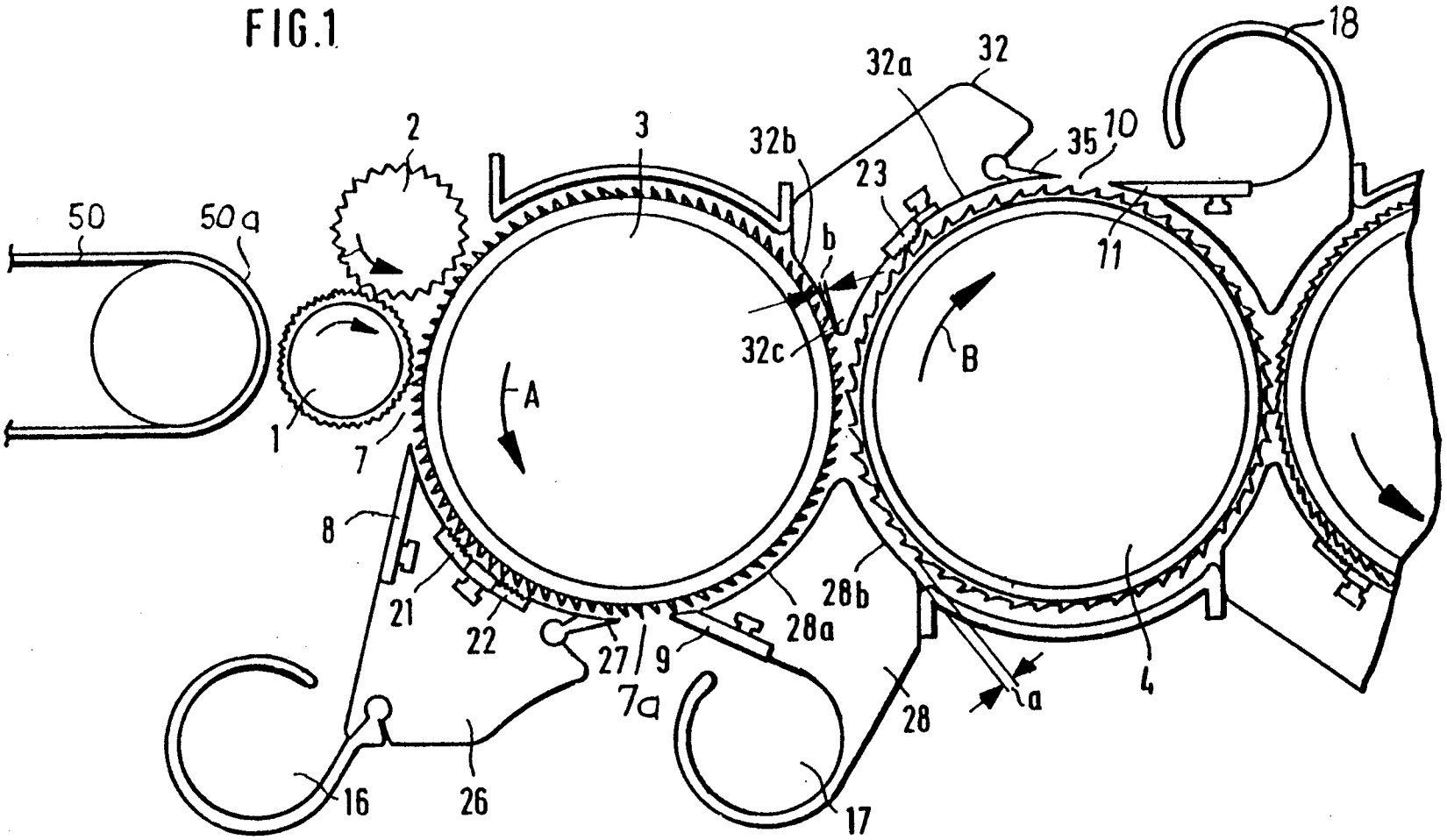
FIG. 1 is a schematic side elevational view of a fiber cleaner incorporating a preferred embodiment of the invention.

FIG. 1 illustrates a fiber cleaning apparatus accommodated in a closed housing (not shown). Fiber material, particularly cotton fiber tufts, is supplied to the cleaning apparatus by, for example, a non-illustrated feed chute which deposits the fiber material on an inlet end of a conveyor belt 50 which, at its discharge end 50*a*, forwards the fiber material to cooperating feed rolls 1 and 2. The feed rolls 1, 2, while clamping the material in their nip, advance the same to a roll 3 which is provided with pins and which may have a diameter of 150–300 mm, for example, 250 mm. The roll 3 is supported in the housing and is rotated counterclockwise as indicated by the arrow A, to have a circumferential speed of approximately 10–25 m/sec, for example, 15 m/sec. Down-stream of the roll 3 a sawtooth roll 4 is arranged which has the same diameter as the roll 3, and is rotated clockwise (arrow B) to have a circumferential speed of approximately 15–25 m/sec, for example, 20 m/sec.

The housing which surrounds the pin roll 3 is provided with a waste discharge opening 7 for allowing passage of fiber waste. The size of the waste discharge opening 7 is adapted to the size and degree of soiling of the fiber material. The waste discharge opening 7 is bounded by a mote knife 8 situated at the downstream end of the waste discharge opening 7, as viewed in the rotary direction A of the roll 3. The roll 3 cooperates with a further waste discharge opening 7*a* bounded by a mote knife 9. Downstream of the mote knife 8, as viewed in the direction of rotation A, two clothed stationary carding elements 21 and 22 are arranged. The sawtooth roll 4 is associated with a waste discharge opening 10 and a mote knife 11.

In the description which follows, the operation of the above-described apparatus will be set forth.

The fiber lap formed of fiber tufts is advanced on the conveyor belt 50 and is, at its discharge end 50*a*, introduced into the nip defined by the cooperating feed rolls 1 and 2 and is, under the clamping effect of the feed rolls 1 and 2 which rotate in the direction of arrows 1*a* and 2*a*, respectively, advanced to the pin roll 3 which combs the fiber material and entrains fiber clusters therewith. As the fiber material is carried by the roll past the waste discharge opening 7 and the mote knife 8, short fibers and coarse waste are thrown out of the fiber material by centrifugal forces dependent upon the circumferential speed and curvature of the roll 3 as well as the size of the waste discharge opening 7 which is adapted to this first cleaning phase. The cleaned fiber material is taken over from the roll 3 by the clothing points of the roll 4 and the fiber material is further opened during such takeover process. As the fiber material, entrained by the roll 4, passes by the waste discharge opening 10 bounded by the mote knife 11, further waste is thrown out by centrifugal forces.

The waste passing through the waste discharge openings 7, 7*a* and 10 is introduced into respective suction hoods 16, 17 and 18 from which the waste is pneumatically removed through conduits, not shown.

Underneath the roll 3 a carrier 26 is situated on which the mote knife 8, the suction hood 16, the stationary carding elements 21 and 22 as well as an adjustable guide element 27 are mounted.

In the lower bight defined between the rolls 3 and 4 a carrier 28 is situated which has a curved edge face 28*a* that conforms to the curvature of the circumference of the roll 3 and a curved edge face 28*b* which, in turn, conforms to the curvature of the circumference of the roll 4. The carrier 28 supports a mote knife 9, having a waste separating edge 9*a* oriented against the direction of rotation A of the upstream arranged roll 3. The edge surface 28*a* of the carrier element 28 partially covers the fiber guiding portion of the roll 3. The carrier 28 and the suction hood 17 constitute a one-piece component. Between the curved edge surface 28*b* of the carrier element 28 and the downstream-arranged roll 4 a clearance a is provided through which an air stream may enter from the outside.

In the upper bight between the rolls 3 and 4 a further carrier 32 is provided which has a curved edge surface 32*a* covering one part of the circumference of the roll 4 and further has an edge surface 32*b* which, in turn, covers one part of the circumferential surface of the roll 3. At the downstream end of the surface 32*a*, as viewed in the direction of rotation of the roll 4, an adjustable guide element 35 is provided. Between the curved edge surface 32*b* of the carrier 32 and the roll 3 a narrow gap b is maintained, to provided for a stripping of residual fiber material by a nose 32*c*. Most of the fiber material has already been transferred from the roll 3 to the roll 4 upstream of the nose 32*c*, as viewed in rotary directions A, B.

Figure 2:
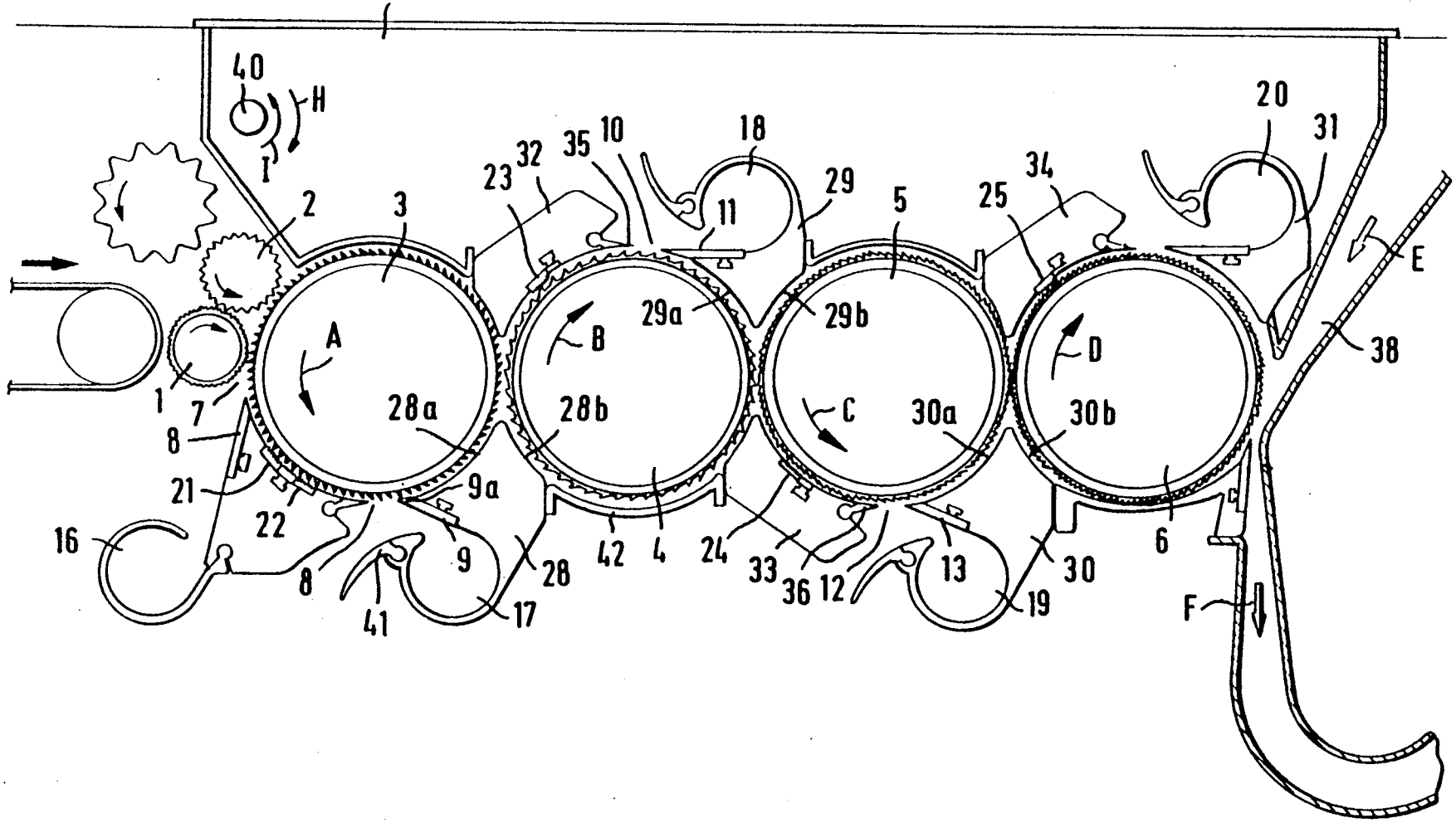
FIG. 2 is a schematic side elevational view of a fiber cleaner, incorporating a plurality of devices structured according to the preferred embodiment.

Turning to FIG. 2, there are provided four rolls 3, 4, 5 and 6 in series; their direction of rotation is designated with A, B, C and D. In the lower bights formed by pairs of rolls 3–4, 4–5, 5–6, there are arranged carriers 28, 33 and 30 while in the upper bights carriers 32, 29 and 34 are accommodated. A curved housing part 42 extends between the carriers 28 and 33. A stationary carding element 24 is mounted on the carrier 33 for cooperation with the roll 5. At the end of the last roll 6 there is arranged a pneumatic duct 38 for guiding an air stream E for stripping the fiber material from the roll 6 and carrying it away as a combined air/fiber stream F. The mote knives, suction hoods, stationary carding elements and guide elements associated with the carriers 29, 30, 34 and 31 correspond structurally and operationally to the respective components described in connection with FIG. 1. The rolls 3, 4, 5 and 6 have identical diameters and the circumferential speed of each successive roll is higher than that of the preceding roll (as viewed in the direction of fiber advance within the cleaning apparatus).

The carriers 32, 29, 34 and 31 are secured to a common cover 39 which may be swung in the direction of arrows I and H in a vertical plane about a pivot shaft 40 held in a machine frame. By a pivotal adjustment of the guide elements (such as components 35, 36, 41) relative to the respective suction hood on which they are mounted, the flow rate of intake air may be adjusted.

Figure 3:
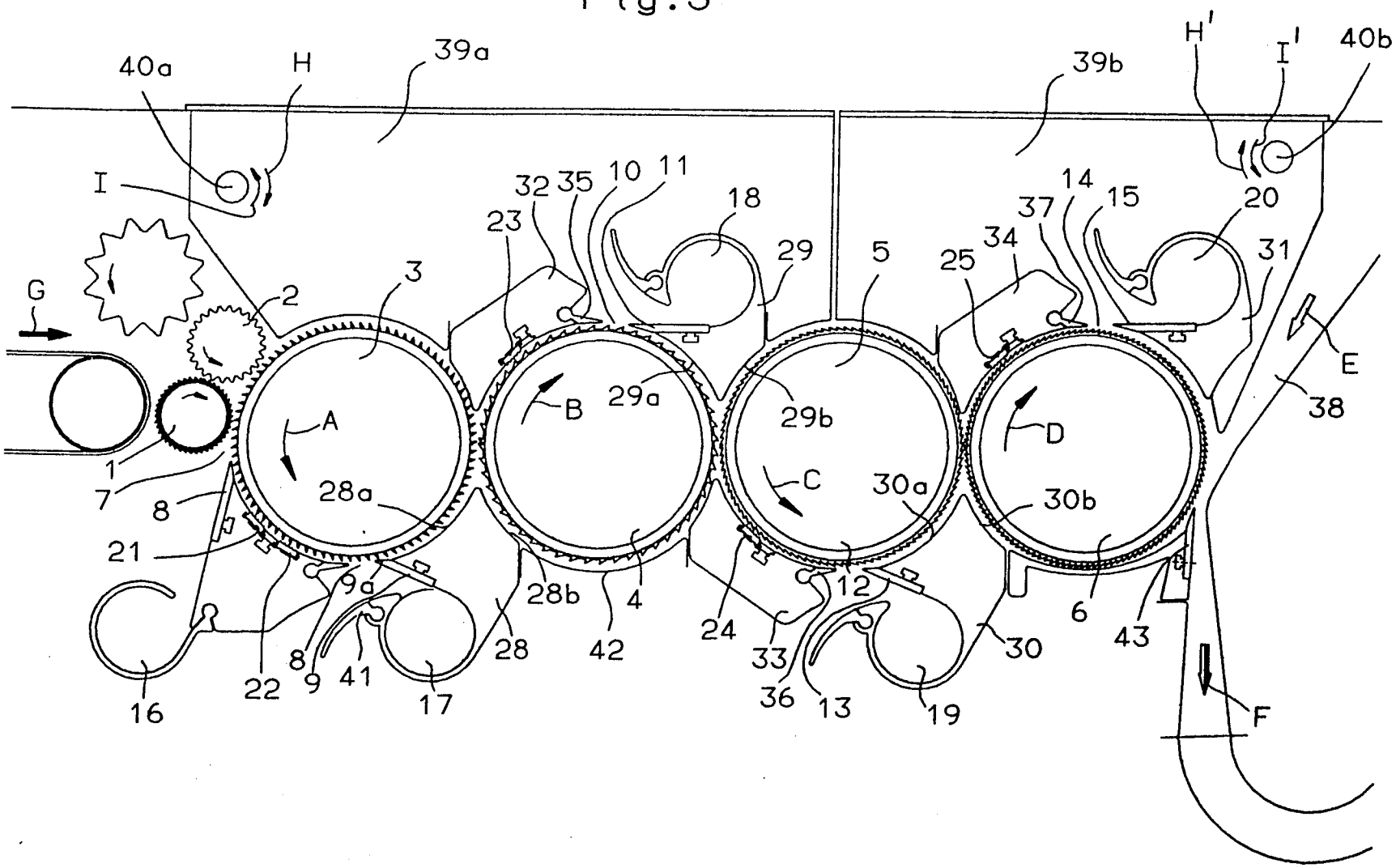
FIG. 3 is a schematic side elevational view of a fiber cleaner, incorporating a plurality of devices structured according to a further preferred embodiment.

Turning to FIG. 3, the carriers 29 and 32 are mounted on a cover member 39*a* which may be swung away and back into its shown position in the direction of arrows I, H about a pivot 40*a*, whereas the carriers 31 and 34 are mounted on a cover member 39*b* which may be swung away from and back into its shown position in the direction of arrows H′ and I′ about a pivot 40*b*.

It will be understood that the above description of the present invention is susceptible to various modifications, changes and adaptations, and the same are intended to be comprehended within the meaning and range of equivalents of the appended claims.

What is claimed is:

1. In a fiber processing machine including two oppositely rotated, tangentially cooperating first and second clothed rolls, wherein said first roll is an upstream roll and said second roll is a downstream roll as viewed in a travelling direction of fiber material being entrained by the rolls on fiber-advancing portions thereof; said rolls having a generally horizontal axis of rotation and together defining opposite first and second converging gaps; a first carrier disposed in said first converging gap and partially extending over a circumferential portion of said first and second rolls; the improvement comprising a mote knife mounted on said first carrier and bounding waste discharge opening situated circumferentially along one of said rolls, further wherein said first carrier has a carrier part partially covering said fiber-advancing portion of said first roll; further comprising a second carrier disposed in said second converging gap; said second carrier having curved carrier parts extending over portions of circumferences of said first and second rolls and a suction hood mounted on said second carrier.

2. In a fiber processing machine including two oppositely rotated, tangentially cooperating first and second clothed rolls, wherein said first roll is an upstream roll and said second roll is a downstream roll as viewed in a travelling direction of fiber material being entrained by the rolls on fiber-advancing portions thereof; said rolls having a generally horizontal axis of rotation and together defining opposite first and second converging gaps; a first carrier disposed in said first converging gap and partially extending over a circumferential portion of said first and second rolls; the improvement comprising a mote knife mounted on said first carrier and bounding a waste discharge opening situated circumferentially along one of said rolls, further wherein said first carrier has a carrier part partially covering said fiber-advancing portion of said first roll; and an additional curved carrier part extending along a circumference of said second roll; said additional curved carrier part defining an air intake gap with said second roll; further comprising a second carrier disposed in said second converging gap; said second carrier having curved carrier parts extending over portions of circumferences of said first and second rolls.

3. The fiber processing machine as defined in claim 2, wherein said first carrier is a one-piece component.

4. The fiber processing machine as defined in claim 2, wherein said carrier part of said first carrier is curved and conforms to a circumference of said first roll.

5. The fiber processing machine as defined in claim 2, further comprising means for adjusting a size of said air intake gap.

6. The fiber processing machine as defined in claim 2, wherein the curved carrier parts of said second carrier meet in a nose portion arranged for stripping fiber material from said first roll.

7. In a fiber processing machine including two oppositely rotated, tangentially cooperating first and second clothed rolls, wherein said first roll is an upstream roll and said second roll is a downstream roll as viewed in a travelling direction of fiber material being entrained by the rolls on fiber-advancing portions thereof; said rolls having a generally horizontal axis of rotation and together defining opposite first and second converging gaps; a first carrier disposed in said first converging gap and partially extending over a circumferential portion of said first and second rolls; the improvement comprising a mote knife mounted on said firs carrier and bounding a waste discharge opening situated circumferentially along one of said rolls, further wherein said first carrier has a carrier part partially covering said fiber-advancing portion of said first roll; further comprising a second carrier disposed in said second converging gap; said second carrier having curved carrier parts extending over portions of circumferences of said first and second rolls; further comprising a suction hood situated adjacent the waste discharge opening for receiving waste passing through said waste discharge opening from said one roll; said first carrier and said suction hood forming a one-piece construction.

8. In a fiber processing machine including two oppositely rotated, tangentially cooperating first and second clothed rolls, wherein said first roll is an upstream roll and said second roll is a downstream roll as viewed in a travelling direction of fiber material being entrained by the rolls on fiber-advancing portions thereof; said rolls having a generally horizontal axis of rotation and together defining opposite first and second converging gaps; a first carrier disposed in said first conveying gap and partially extending over a circumferential portion of said first and second rolls; the improvement comprising a mote knife mounted on said first carrier and bounding a waste discharge opening situated circumferentially along one of said rolls, further wherein said first carrier has a carrier part partially covering said fiber-advancing portion of said first roll; further comprising a second carrier disposed in said second conveying gap; said second carrier having curved carrier parts extending over portions of circumferences of said first and second rolls; and further comprising a guide element angularly adjustably mounted on said second carrier and cooperating with said second roll.

9. The fiber processing machine as defined in claim 8, further comprising a stationary clothed carding element mounted on said second carrier.

10. In a fiber processing machine including at least three consecutive, mutually oppositely rotated, tangentially cooperating first , second and third clothed rolls; said rolls having a generally horizontal axis of rotation and any adjoining two rolls together defining opposite first and second converging gaps; a first carrier disposed in said first converging gap and partially extending over a circumferential portion of said first and second rolls; the improvement comprising a mote knife mounted on said first carrier and bounding a waste discharge opening situated circumferentially along one of said rolls, further wherein said first carrier has a carrier part partially covering said fiber-advancing portion of said first roll; further comprising at least two second carriers each disposed in a respective second converging gap; said second carriers having curved carrier parts extending over portions of circumferences of two adjoining rolls; and further comprising a movable cover pivotally mounted on a machine frame for swinging motion about a horizontal axis; said second carriers being mounted on said movable cover.

11. In a fiber processing machine including at least three consecutive, mutually oppositely rotated, tangentially cooperating first, second and third clothed rolls; said rolls having a generally horizontal axis of rotation and any adjoining two rolls together defining opposite first and second converging gaps; a first carrier disposed in said first converging gap and partially extending over a circumferential portion of said first and second rolls; the improvement comprising a mote knife mounted on said first carrier and bounding a waste discharge opening situated circumferentially along one of said rolls, further wherein said first carrier has a carrier part partially covering said fiber-advancing portion of said first roll; further comprising at least two second carriers each disposed in a respective second converging gap; said second carriers having curved carrier parts extending over portions of circumferences of two adjoining rolls; and further comprising two movable covers; at least one separate carrier being mounted on each said cover; each said cover being pivotally mounted on a machine frame for swinging motion about an axis.

* * * * *